US005979577A

United States Patent [19]

Fielder

[11] Patent Number: 5,979,577

[45] Date of Patent: Nov. 9, 1999

[54] STABILIZING DRILL BIT WITH IMPROVED CUTTING ELEMENTS

[75] Inventor: Coy M. Fielder, Cypress, Tex.

[73] Assignee: Diamond Products International, Inc., Houston, Tex.

[21] Appl. No.: 09/149,196

[22] Filed: Sep. 8, 1998

Related U.S. Application Data

[63] Continuation of application No. 08/655,988, May 31, 1996, Pat. No. 5,803,196.

[51] Int. Cl.[6] ..... E21B 10/16; E21B 10/46

[52] U.S. Cl. ..... 175/431; 175/434

[58] Field of Search ..... 175/335, 350, 175/378, 379, 431, 434

[56] References Cited

U.S. PATENT DOCUMENTS

| | | | |
|---|---|---|---|
| 5,197,554 | 3/1993 | Zijsling | 175/393 |
| 5,199,511 | 4/1993 | Tibbitts et al. | 175/65 |
| 5,238,075 | 8/1993 | Keith et al. | 175/431 |
| 5,549,171 | 8/1996 | Mensa-Wilmot et al. | 175/431 |
| 5,558,170 | 9/1996 | Thigpen et al. | 175/57 |
| 5,582,261 | 12/1996 | Keith et al. | 175/431 |
| 5,607,025 | 3/1997 | Mensa-Wilmot et al. | 175/431 |
| 5,649,604 | 7/1997 | Fuller et al. | 175/431 |

*Primary Examiner*—Frank Tsay
*Attorney, Agent, or Firm*—Sankey & Luck, L.L.P.

[57] ABSTRACT

A drilling tool operational with a rotational drive source for drilling in a subterranean formation where said tool comprises a body defining a face disposed about a longitudinal axis, a plurality of cutting elements fixedly disposed on and projecting from said tool face and spaced apart from one another, and one or more stabilizing elements disposed on the tool face and defining a beveled surface.

32 Claims, 5 Drawing Sheets

FIG. 4A
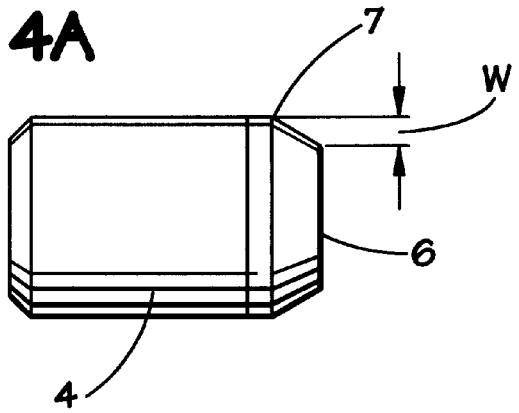
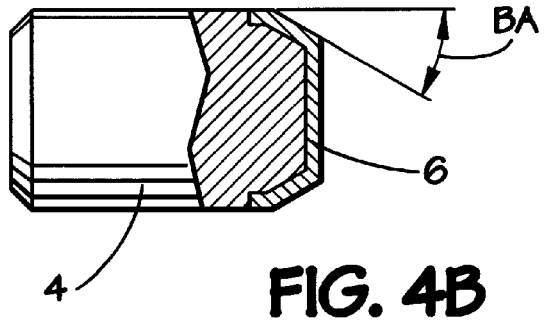
FIG. 4B
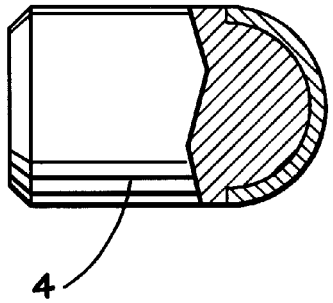
FIG. 4C

STABILIZING DRILL BIT WITH IMPROVED CUTTING ELEMENTS

CROSS REFERENCE TO RELATED APPLICATIONS

This application is a continuation application of applicant's application Ser. No. 08/655,988, filed on May 31, 1996, now U.S. Pat. No. 5,803,196, the contents of which are herein incorporated by reference.

BACKGROUND OF THE INVENTION

1. Field of the Invention

The present invention relates to improved subterranean drill bits and abrasive cutter elements for application with such bits. More specifically, the present invention is directed to a stabilized drill bit including an improved cutting element incorporating enhanced wear characteristics.

2. Description of the Prior Art

Diamond cutters have traditionally been employed as the cutting or wear portion of drilling and boring tools. Known applications for such cutters include the mining, construction, oil and gas exploration and oil and gas production industries. An important category of tools employing diamond cutters are those drill bits of the type used to drill oil and gas wells.

The drilling industry classifies commercially available drill bits as either roller bits or diamond bits. Roller bits are those which employ steel teeth or tungsten carbide inserts. As the name implies, diamond bits utilize either natural or synthetic diamonds on their cutting surfaces. A "fixed cutter", as that term is used both herein and in the oil and gas industries, describes drill bits that do not employ a cutting structure with moving parts, e.g. a rolling cone bit.

The International Association of Drilling Contractors (IADC) Drill Bit Subcommittee has officially adopted standardized fixed terminology for the various categories of cutters. The fixed cutter categories identified by IADC include polycrystalline diamond compact (pdc), thermally stable polycrystalline(tsp), natural diamond and an "other" category. Fixed cutter bits falling into the IADC "other" category do not employ a diamond material as any kind as a cutter. Commonly, the material substituted for diamond includes tungsten carbide. Throughout the following discussion, references made to "diamond" include pdc, tsp, natural diamond and other cutter materials such as tungsten carbide.

An oil field diamond bit typically includes a shank portion with a threaded connection for mating with a drilling motor or a drill string. This shank portion can include a pair of wrench flats, commonly referred to a "breaker slots", used to apply the appropriate torque to properly make-up the threaded shank. In a typical application, the distal end of the drill bit is radially enlarged to form a drilling head. The face of the drilling head is generally round, but may also define a convex spherical surface, a planar surface, a spherical concave segment or a conical surface. In any of the applications, the body includes a central bore open to the interior of the drill string. This central bore communicates with several fluid openings used to circulate fluids to the bit face. In contemporary embodiments, nozzles situated in each fluid opening control the flow of drilling fluid to the drill bit.

The drilling head is typically made from a steel or a cast "matrix" provided with polycrystalline diamond cutters. Prior art steel bodied bits are machined from steel and typically have cutters that are press-fit or brazed into pockets provided in the bit face. Steel head bits are conventionally manufactured by machining steel to a desired geometry from a steel bar, casting, or forging. The cutter pockets and nozzle bores in the steel head are obtained through a series of standard turning and milling operations. Cutters are typically mounted on the bit by brazing them directly into a pocket. Alternatively, the cutters are brazed to a mounting system and pressed into a stud hole, or, still alternatively, brazed into a mating pocket.

Matrix head bits are conventionally manufactured by casting the matrix material in a mold around a steel core. This mold is configured to give a bit of the desired shape and is typically fabricated from graphite by machining a negative of the desired bit profile. Cutter pockets are then milled into the interior of the mold to proper contours and dressed to define the position and angle of the cutters. The internal fluid passageways in the bit are formed by positioning a temporary displacement material within the interior of the mold which is subsequently removed. A steel core is then inserted into the interior of the mold to act as a ductile center to which the matrix materials adhere during the cooling stage. The tungsten carbide powders, binders and flux are then added to the mold around the steel core. Such matrices can, for example, be formed of a copper-nickel alloy containing powdered tungsten carbide. Matrices of this type are commercially available to the drilling industry from, for example, Kennametal, Inc.

After firing the mold assembly in a furnace, the bit is removed from the mold after which time the cutters are mounted on the bit face in the preformed pockets. The cutters are typically formed from polycrystalline diamond compact (pdc) or thermally stable polycrystalline (tsp) diamond. PDC cutters are brazed within an opening provided in the matrix backing while tsp cutters are cast within pockets provided in the matrix backing.

Cutters used in the above categories of drill bits are available from several commercial sources and are generally formed by sintering a polycrystalline diamond layer to a tungsten carbide substrate. Such cutters are commercially available to the drilling industry from General Electric Company under the "STRATAPAX" trademark. Commercially available cutters are typically cylindrical and define planar cutting faces.

The cutting action in prior art bits is primarily performed by the outer semi-circular portion of the cutters. As the drill bit is rotated and downwardly advanced by the drill string, the cutting edges of the cutters will cut a helical groove of a generally semicircular cross-sectional configuration into the face of the formation.

Bit vibration constitutes a significant problem both to overall performance and bit wear life. The problem of vibration of a drilling bit is particularly acute when the well bore is drilled at a substantial angle to the vertical, such as in the recently popular horizontal drilling practice. In these instances, the drill bit and the adjacent drill string are subjected to the downward force of gravity and a sporadic weight on bit. These conditions produce unbalanced loading of the cutting structure, resulting in radial vibration.

Prior investigations of the effects of the vibration on a drilling bit have developed the phraseology "bit whirl" to describe this phenomena. One solution proposed by such investigations is the utilization of a low friction gauge pad on the drill bit.

One known cause of vibration is imbalanced cutting forces on the bit. Circumferential drilling imbalance forces exist to some degree on every drill bit. These imbalance forces tend to push the drill bit towards the side of the bore hole. In the example where the drill bit is provided with a normal cutting structure, the gauge cutters are designed to cut the edge of the borehole. During the cutting process, however, the effective friction between the cutters near the gauge area increases. When this occurs, the instantaneous center of rotation is translated to a point other than the geometric center or longitudinal axis of the bit. The usual result is for the drill bit to begin a reverse or backwards "whirl" around the borehole. This "whirling" process regenerates itself because insufficient friction is generated between the drill bit gauge and the borehole wall, regardless of bit orientation. This whirling also serves to change the bit center of rotation as the drill bit rotates. Thus, the cutters travel faster, in the sideways and backwards direction, and are subjected to greatly increased impact loads.

Another cause of bit vibration is from the effects of gravity. When drilling a directional hole, the drill string maintains a selected angle vis-a-vis the vertical. The drill string continues to maintain this vertical deflection even during a lateral drilling procedure. The radial forces inducing this vertical deflection can also result in bit "whirl".

Steering tools also result in bit vibration. One such cause for vibration in a steering tool occurs as a result of a bent housing. Vibration occurs when the bent housing is rotated in the bore hole resulting in off center rotation and subsequent bit whirl. Bit tilt also creates bit whirl and occurs when the drill string is not properly oriented vis-a-vis the center of the borehole. In such occasions, the end of the drill sting, and thus the drill bit, is slightly tilted.

Yet another source of bit whirl results from stratification of subsurface formations. When drilling well bores in subsurface formations it often happens that the drill bit passes readily through a comparatively soft formation and strikes a significantly harder formation. In such an instance, rarely do all of the cutters on a conventional drill bit strike this harder formation at the same time. A substantial impact force is therefore incurred by the one or two cutters that initially strike the harder formation. The end result is high impact load on the cutters of the drill bit, vibration and subsequent bit whirl.

Whatever the source of the vibration, the resulting "whirl" generates a high impact on a few of the cutters against the formation, thereby lessening drill bit life.

A number of solutions have been proposed to address the above and other disadvantages of prior art bits associated with vibration and subsequent bit "whirl". Some of these solutions have proposed the use of various geometries of the bit cutters to improve their resistance to chipping. Other proposed solutions have been directed at the use of gauge pads and protrusions placed behind the cutters.

None of these proposed solutions, however, has disclosed or suggested the use of discrete stabilizing elements whose contact face is disposed at an exaggerated angle of attack or contact vis-a-vis the formation. Quite the contrary, conventional wisdom in the drilling industry has taught that the use of exaggerated cutting angles would detrimentally impact the penetration rate of the drill bit.

Still other solutions have involved the use of shaped cutters to PDC bits to prevent bit whirl. It was traditionally believed that a shaped cutter served as a stabilizing element at any depth of cut.

Disadvantages associated with the use of traditional shaped cutters as a stabilizing element include limited wear life. In this connection, while the shaped cutter in an unsharpened condition acts as a constant stabilizing element, the nature of the cutter changes as it begins to wear. When the depth of the cut is excessive or wear removes the chamfer, the shaped cutter acts as an unchamfered cutter, and therefore loses its effectiveness as a stabilizing element in the borehole.

SUMMARY OF THE INVENTION

The present invention addresses the above and other disadvantages of prior art drill bits and is directed to an improved drill bit to minimize drill bit vibration and decrease cutter wear.

In one embodiment, the drill bit of the present invention defines a shank disposed about a longitudinal axis for receiving a rotational drive source, a gauge portion extending from the shank portion and a face portion disposed about the longitudinal axis and extending from the gauge portion. This face portion typically includes a number of blades arranged in a symmetrical configuration. In alternate embodiments, the cutter face may include a smaller diameter cutting zone, usually referred to as a pilot section, which extends coaxially from a larger diameter cutting zone.

A plurality of cutting elements are disposed on the bit face about the longitudinal axis. Interposed among these cutting elements are stabilizing elements placed on one or more blades of the bit. These stabilizing elements are radially situated on the bit face so as to achieve a sufficient depth of cut to aid in stabilizing the bit. Furthermore, these stabilizing elements are disposed at an exaggerated cutting angle vis-a-vis the formation.

These stabilizing elements are preferably formed of polycrystalline diamond carbide or some other hard compound, e.g. carbide, adapted to cut rock.

The present invention also addresses the above and other disadvantages of prior art shaped cutters which may be used to minimize drill bit vibration.

In a another embodiment, the cutter of the present invention includes a body and a polycrystalline diamond cutting face which are bonded together using conventional techniques. The body is comprised of a cemented tungsten carbide which includes a chamfer cut at a selected angle, e.g. forty-five degrees. Polycrystalline diamond is bonded to the body so as to create a diamond table having an enhanced depth of diamond and to define a constant and enhanced diamond thickness along the length of the rake land. In such a fashion, the diamond cutting surface is strengthened as a result of increased and consistent thickness throughout its length.

The cutter system of the present invention presents a number of advantages over the art. One such advantage is decreased bit whirl and vibration through even highly stratified formations.

A second advantage is the strengthening of the cutting elements themselves as a result of the modified wear surface, thereby enhancing bit wear life.

Another advantage is increased wear life of the cutter created as a result of the increased length of the rake land.

Increased wear life of the cutter is also increased as a result of increased and consistent thickness of polycrystallic diamond along the rake land.

BRIEF DESCRIPTION OF THE DRAWINGS

FIG. 4A–C illustrates several embodiments of the stabilizing element of the present invention.

DETAILED DESCRIPTION OF THE PREFERRED EMBODIMENT

Figure 7:
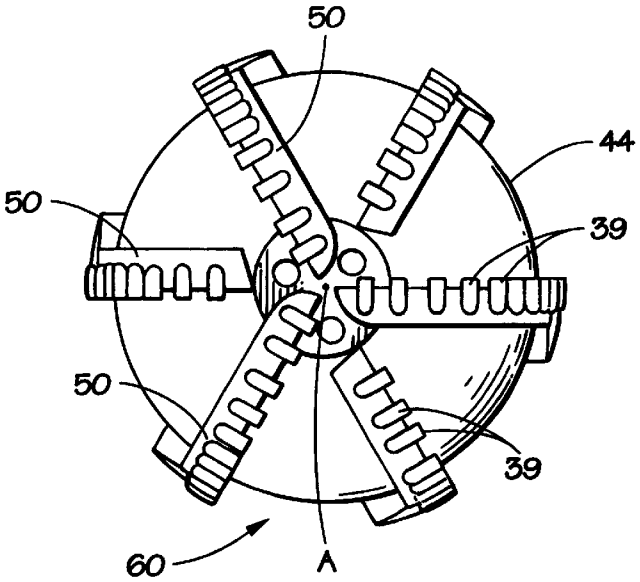
FIG. 7 illustrates a bottom view of the drill bit illustrated in FIG. 6.
Figure 6:
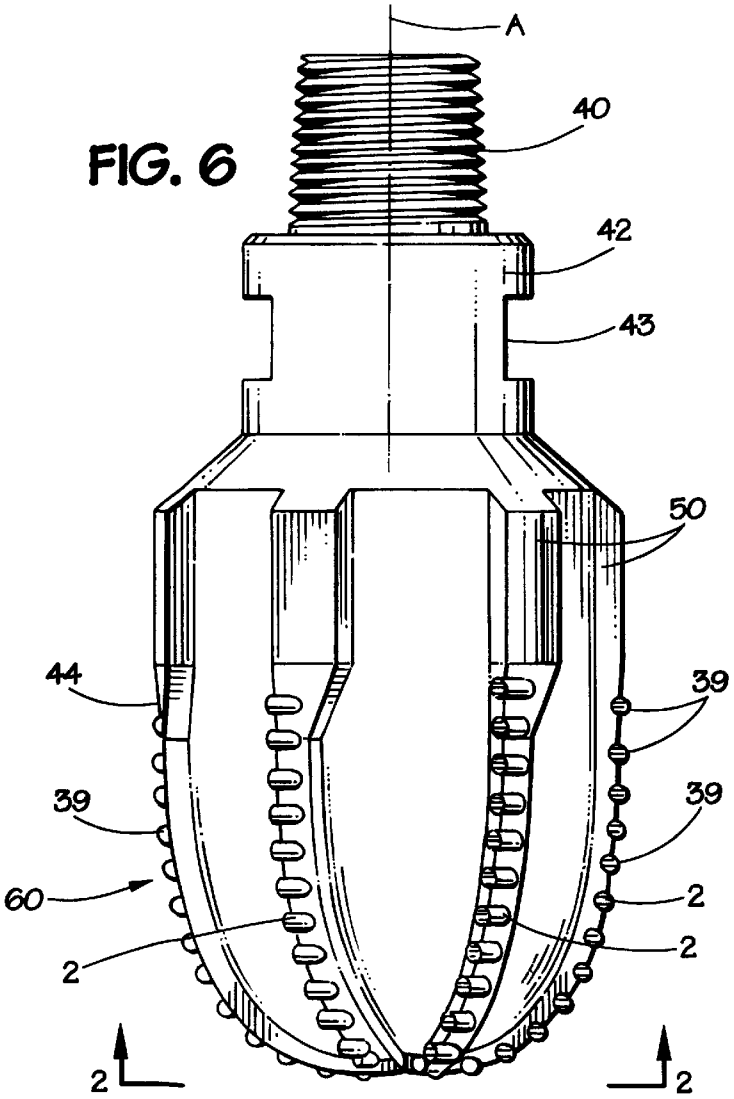
FIG. 6 illustrates a side view of an embodiment of a drill bit made including stabilizing elements made in accordance with the present invention.

FIGS. 6 and 7 represent one embodiment of a drill bit 60 manufactured in accordance with the methodology of the present invention. By reference to the figures, the drill bit 60 comprises a threaded portion 40 for attachment to the drill string or other rotational drive source and disposed about a longitudinal axis "A", a shank portion 42 extending from the gauge 40, and a face portion 44 extending from the gauge portion 42. As illustrated, shank portion 42 may include a series of wrench flats 43 used to apply torque to properly make up the thread 40.

In a typical embodiment, bit face 44 is defined by a series of cutting blades 50 which form a continuous linear contact surface from axis "A" to gauge 42. When viewed from the bottom, blades 50 may describe a generally helical or a linear configuration. (As shown in FIGS. 6 and 7) Blades 50 are provided with a number of cutting elements 39 disposed about their surface in a conventional fashion, e.g. by brazing or force fitting. The number of these elements 39 is typically determined by the available surface area on blades 50, and may vary from bit to bit.

Figure 3:
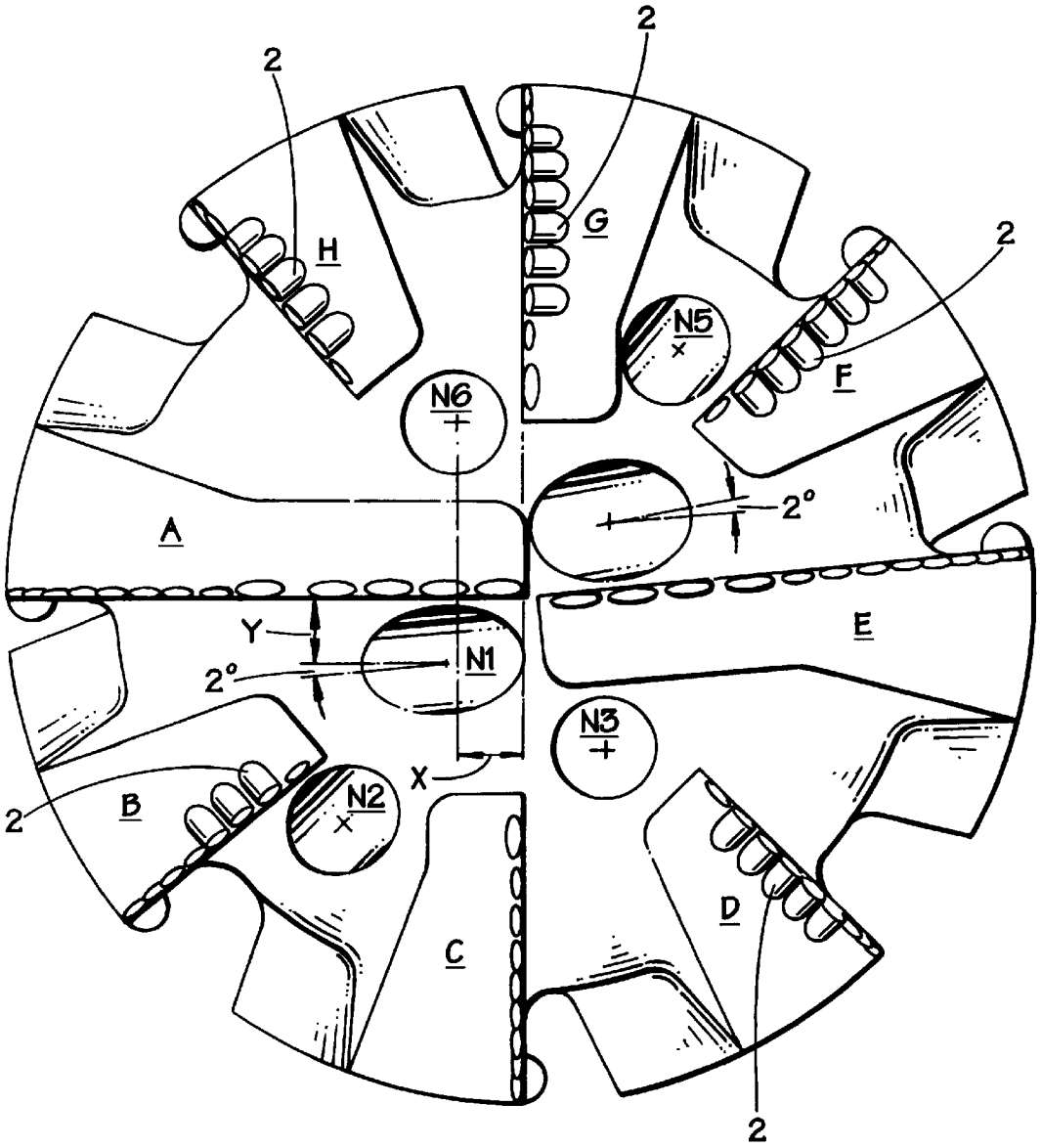
FIG. 3 illustrates a bottom view of one embodiment of a drill bit made in accordance with the present invention which includes stabilizing elements manufactured in accordance with the present invention.

A series of stabilizing elements 2 are disposed on the bit face 44 in a selected manner to stabilize bit 60 during operation (See FIG. 3). The methodology involved in the placement of these elements 2 is as follows: A geometrical analysis is made of the bit face 44 by creating a array of spatial coordinates defining the center of each cutter 39 relative to the longitudinal axis "A". A vertical reference plane is next created, which plane containing the longitudinal axis. Coordinates defining the center of each cutter 39 are then rotated about this axis "A" and projected onto the reference plane to define a cutter profile such as those illustrated in FIG. 1. In this connection, the cutter profile illustrated in FIG. 1 represents an aggregate pictorial side section of each of the cutters 39 on bit 60 as the bit is revolved about axis "A".

Figure 1:
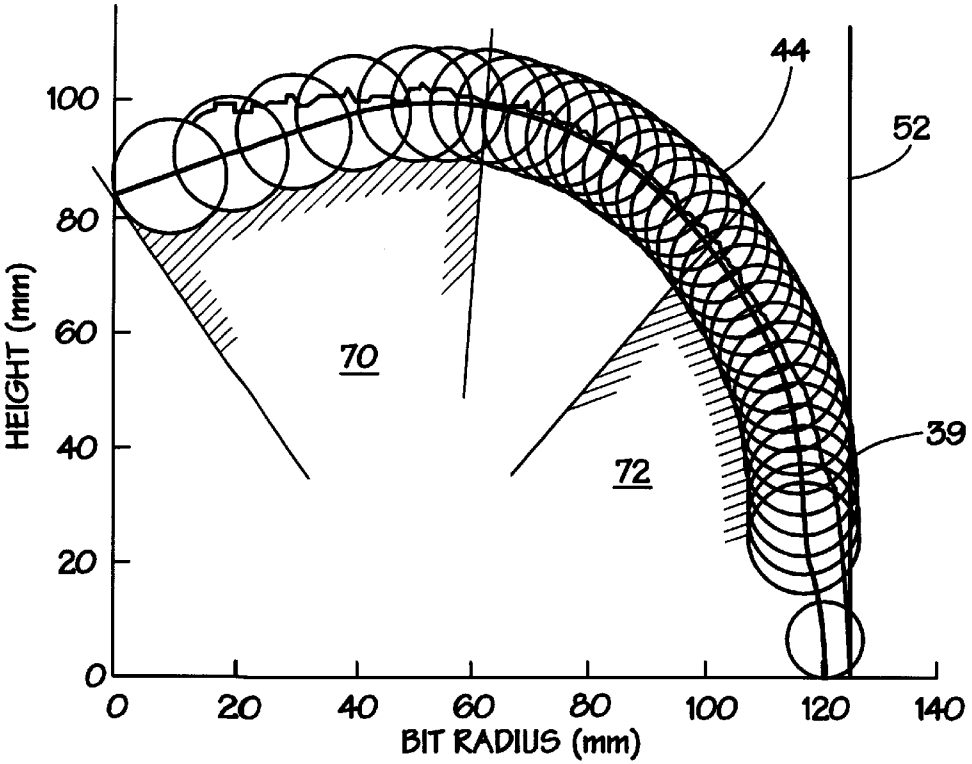
FIG. 1 graphically illustrates a typical cutter drilling profile highlighting cutter height versus bit radius.

FIG. 1 illustrates a typical cutter profile of a drill bit made in accordance with the above described methodology where the x axis is taken along the longitudinal axis "A". As illustrated, drill bit face 44 defines an arc intercepting the bit gauge indicated by line 52. As illustrated in FIG. 1, the cutters 39 positioned in the intermediate zone 70 are more widely spaced and therefore experience a greater depth of cut into the formation.

Zone 72 defines a segment of the cutter arc between 0 and 60 degrees as measured from a line normal to the longitudinal axis "A". Elements 2 are preferably placed within the 60 degree arc of this zone 72 to achieve maximum stability of the drill bit during operation. It has been discovered that elements 2 placed within this arc afford the greatest stabilizing benefits while minimizing any negative impact on the penetration rate of the bit 60.

Positions for stabilizing elements 2 are selected on the bit face 44 so that such elements 2 remain in substantially continuous and constant contact with the formation. Cutter positions are determined on the basis of the need for a stabilizing force on the bit. The need for this stabilizing force is in turn determined by drilling conditions. The stabilizing elements are preferably placed on consecutive cutters.

By reference to FIG. 1, this optimum position for element 2 falls within the zone 72 identified earlier. To further stabilize bit 60, it is desirable to position elements 2 in a substantially symmetrical fashion among blades 50. In this connection, any radial reactive force imported by a given element 2 will be offset by a corresponding element 2 placed on corresponding blades 50. Stabilizing elements 2 may be positioned between two or more of the typical cutters 30. In selected areas of the cutter profile, several elements 2 are preferably placed in adjacent positions on the cutter blade 50 so as to ensure substantially continuous contact with the formation.

Various embodiments of the stabilizing element 2 of the present invention may be seen by reference to FIGS. 4A–C. While the illustrated stabilizing elements 2 include chamfered or rounded cutting edges, it is contemplated that any cutter which includes a "less sharp" cutting edge, when compared to those other cutters as the drill bit may be employed. "Less sharp" as used herein relates to the condition of a cutter which cannot effect as much penetration into the formation as an adjacent cutter, weight on bit and angle of attack being equal.

FIG. 4A illustrates a stabilizing element 2 of the present invention comprising a cutter body 4, a cutting face 6 and a cutting edge 7. Cutting face 6 is preferably comprised of a polycrystalline diamond compact (PDC) which is fabricated in a conventional manner. Face 6 is integrally formed with body 4. Alternatively, other hard compounds, e.g. thermally stable polycrystalline diamond or carbide, may also be used to achieve the objectives of the present invention.

Figure 2:
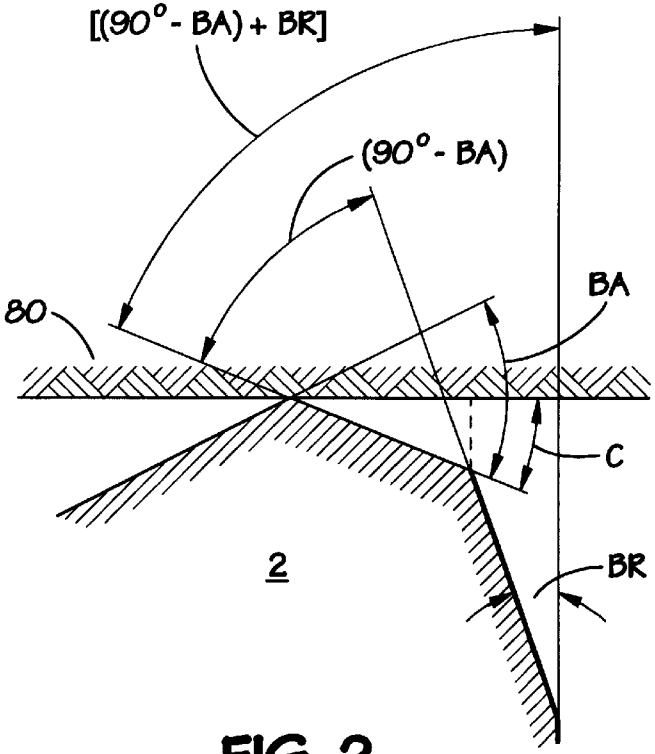
FIG. 2 graphically illustrates the contact angle of a cutter versus the formation.

By reference to FIGS. 2 and 3, the use of elements 2 as a stabilizing force depends both on their positioning on the cutter blade 50 to ensure continuous contact with the formation 80, as described above, and on the their contact angle with the formation 80. To achieve the stabilizing objectives of the invention, these elements should be disposed at a contact angle "C" in the range of 5–55 degrees as measured from a plane defined by the formation. As illustrated, this contact angle is achieved by the combination of a selected back rake angle BR and a beveled or arcuate cutting edge BA on each stabilizing element 2. Back rake angle BR is measured from a line normal to the formation. Bevel angle BA is measured from a line normal to the face 6 of the stabilizing element 2. The back rake angle BR contemplated to be used in the present invention is in the range of 10–30 degrees. The bevel or radii angle BA contemplated for use with elements 2 is from 10–75 degrees. (See also FIG. 4B) The linear dimension of the beveled cutting edge 7 is measured as a function of the projected depth of cut of the formation 80 for a element 2 at a selected position on the blade 50. This depth of cut may be ascertained from the following formula:

$$\frac{ROP\ (\text{ft/hr}) \times 12\,\text{in/ft}}{RPM\ (\text{rev/min})\,60\,\text{min/hr}} = \text{depth of cut}$$

To achieve the stabilization required from elements 2, this bevel dimension "W" is substantially equal to or greater than 100% of the depth of cut projected for the radial position of that element 2 on the cutter face 44. For a conventional cutting element measuring some three eighths to three fourths of an inch in diameter, this bevel is greater than or equal to 0.030 inches. Alternatively, cutting edges 7 may be provided with a radius instead of a beveled cutting edge, where such edge 7, again for a cutter having a diameter between three eighths and three quarters of an inch, is greater than 0.030 inches. (See FIG. 4C)

Stabilizing elements 2, when applied to a drill bit in accordance with the present invention, prevent the initiation of bit whirl in the following manner. When the drill bit is rotated in the borehole, an imbalanced force is created for the reasons earlier identified. The presence of a discrete number of elements 2, arranged about the bit face 44 at a contact angle C, acts as a self correcting force to prevent conventional cutters 39 from cutting too deeply into the formation 80. Since these elements are positioned in the 60 degree arc as measured from a line perpendicular to the longitudinal axis "A", the penetration rate of the bit 60 is only nominally affected.

The Stabilizing Cutter

Figure 5A:
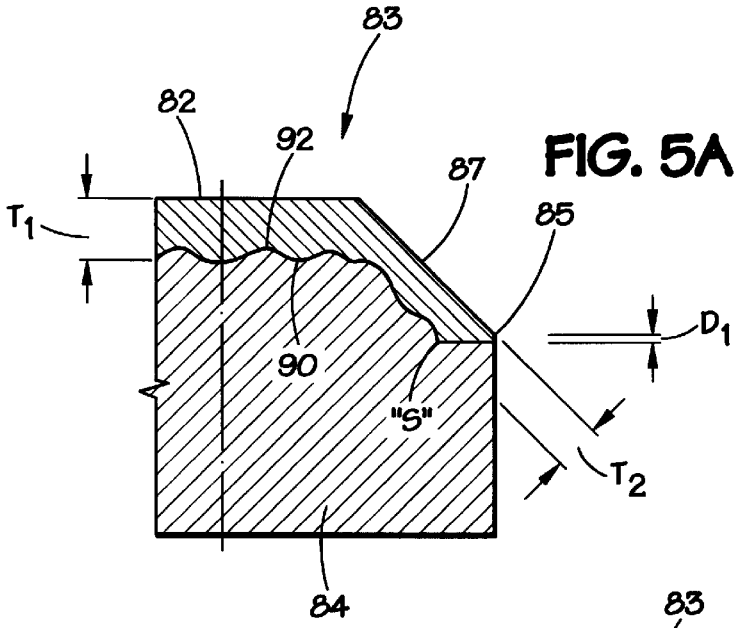
FIG. 5A–B illustrates a side, cross sectional view of prior shaped cutters.
Figure 5B:
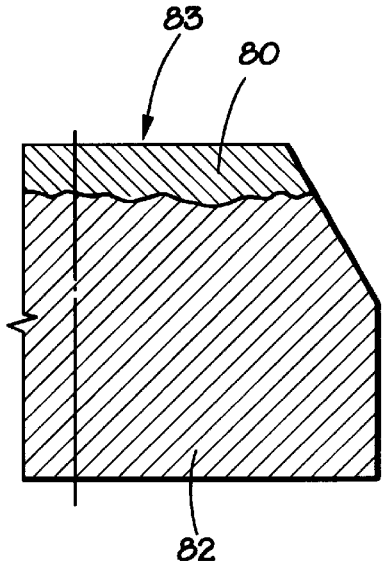

A side cross-section of a conventional stabilizing element 83 may be seen by reference to FIG. 5 and includes a body 84 and a superabrasive layer or diamond table 86 bonded thereto about an interface 80 and defining a cutter face 82, a cutter edge 85 and a rake land 87.

In the illustrated embodiment, stresses encountered during both the manufacture and field application of elements 83 are partially relieved by use of a series of alternating grooves 90 and ridges 92 disposed in the body about interface 80, where such stresses are concentrated at a point designated "S." An example of the use of such grooves and ridges is seen in U.S. Pat. No. 5,007,207 as issued to Phaal. Notwithstanding such efforts, however, element 83 is prone to wear and failure as a result of, among other factors, the lack of a constant thickness of the polycrystalline diamond layer in selected areas and the dimension of the rake land 86.

The thickness of diamond table 86 may be measured at a variety of locations about stabilizing element 83. One such location is along a line parallel to the longitudinal axis "A" and normal to the plane defined by the cutter face 82, designated in FIG. 5 as $T_1$. A second measurement may be taken along a line normal to the plane defined by the rake land 87, designated $T_2$.

Also significant to the performance and use life of stabilizing element 83 is the length of the rear boundary of the cutter face 82 trailing said cutting edge 85. In FIG. 5, this length is designated $D_1$. In prior embodiments, this distance is frequently no more than 0.010 inches.

By reference to FIG. 3, the following are examples of the performance of drill bits constructed in accordance with the foregoing methodology.

EXAMPLE 1

A 10⅝" pilot hole encompassed an interval from 6060 ft. to 12499 ft. MD. The directional objective for this interval was to drill a vertical hole to the kickoff depth at 6100 ft., build angle at 3.00°/100 to 48.89° at 7730 ft. with a direction of S18.40E, then maintain this angle and direction to 12499 ft. MD. The secondary objective was to drill the entire interval with a "MT33M" PDC bit and steerable BHA.

The BHA consisted of a "MT33M" PDC bit, 1¾° Sperry 8" steerable motor, xo sub, 10¼ stab., 6¾" LWD, 6¾" MWD, float sub, 10¼ stab., 6 jts. Hevi-wate, jars, 23 jts. hevi-wate. This BHA was used to drill from 6060 ft. to 12322 ft. in 82.5 drilling hours. The kickoff, from 6120 ft. to 7760 ft., built angle from 0.57° to 49.2°. The average slide section was 38 ft./100 ft., and resulted in an average build rate of 3.12°/100 ft. The tangent interval, from 7760 ft. to 12322 ft., had an average angle of 49.32° with an average direction of S17.54E. The average slide section for the tangent interval was 10 ft./200 ft., resulting in an average dogleg severity of 0.40°/100 ft. The slide sections were mainly devoted to counteracting a slight angle dropping tendency of 0.38°/100 ft. The BHA was pulled out of the hole at 11155 ft. to replace the MWD collar. The same bit and BHA configuration was rerun and it drilled to TD at 12322 ft.

The "MT33M" PDC bit is of a conventional design with 8 blades, with 8 mm. cutters. The back rake of the cutters was 20°. Each blade incorporated one shaped cutter and one reverse bullet. The gauge pads were reduced to 2 in. in length.

This new design bit proved to be very effective in the reduction of the reactive torque associated with the mud motor. The slide intervals during the kickoff and the tangent section of the well demonstrated a 75% reduction in the reactive torque. The bit produced about the same amount of reactive torque as a rock bit. The well was control drilled at an instantaneous penetration rate of 100 ft./hour. This resulted in an average penetration rate of 75.9 ft/hour. The bit weights varied from 5K to 20K while rotary drilling and sliding. Slide intervals were drilled as fast as rotary drilling intervals without encountering any excessive reactive torque. This bit design proved to be very effective in eliminating all of the problems associated with drilling directional wells in highly laminated shales and ratty sand formations.

FIG. 3 illustrates a bottom view of the embodiment of the drill bit described in Example 1. By reference to FIG. 3, stabilizing elements 2 positioned within zone 72 are indicated by asterisks. The angel θ of at which these elements 2 is identified below for the eight blades of the bit.

| | | | |
|---|---|---|---|
| Blade A | 24° | Blade E | 14° |
| Blade B | 11° | Blade F | 24° |
| Blade C | 18° | Blade G | 18° |
| Blade D | 21° | Blade H | 11° |

EXAMPLE 2

In a standard drill bit, an hourly rate of penetration of 47.8 ft/hr and a rate of penetration of 573.6 inches per hour was desired for 190 revolutions per minute. Given these operating parameters the depth of cut is calculated as follows:

$$\frac{[ROP\ (\text{ft/hr}) \times 12\,\text{in/ft}]}{[RPM\ (\text{rev/min}) \times 60\,\text{min/hr}]} = \text{depth of cut}$$

In this example, the projected depth of cut will be 0.05 inches. Therefore, a bevel greater than or equal to 0.050 inches is preferable to achieve the desired objectives of the invention to optimize efficiency where each individual cutter is assumed to take a full depth of cut.

EXAMPLE 3

In a drill bit a rate of penetration of 78.4 ft/hr (940.8 in/hr) was desired for 150 rpm (9000 rph). Given the above parameters, a depth of cut of 0.105 inches was projected, thereby requiring a preferred bevel of greater than or equal to 0.105 inches to optimize efficiency where each individual cutter is assumed to take a full depth of cut.

EXAMPLE 4

In a drill bit a rate of penetration of 66.7 ft/hr (800.4 in/hr) was desired for 150 rpm (9000 rph), yielding a projected depth of cut of 0.089 inches. Therefore, a bevel dimension greater than or equal to 0.089 inches is preferred to optimize efficiency where each individual cutter is assumed to take a full depth of cut.

EXAMPLE 5

In a standard drill bit, a penetration of 75.8 ft/hr (909.6 in/hr) was desired at 160 rpm (9600 rph), yielding a projected depth of cut of 0.095 inches. Therefore, a bevel dimension greater than equal to 0.095 inches is preferred to optimize efficiency where each individual cutter is assumed to take a full depth of cut.

EXAMPLE 6

In a prophetic example necessitating a ROP of 33.8 ft/hr at 210 rpm, a depth of cut of 0.032 is calculated. A bevel dimension of at least 0.032 inches is preferred to optimize efficiency where each individual cutter is assumed to take a full depth of cut.

Imbalance forces acting on a drill bit change with wear, the particular formation in which the bit is operating and operating conditions within the borehole. The magnitude and direction of these imbalance forces can vary significantly. The use of an exaggerated contact angle for cutting edge 7 provides the advantage of being relatively immune to formation inhomogenities and downhole operating conditions. (See FIG. 4A)

Figure 8:
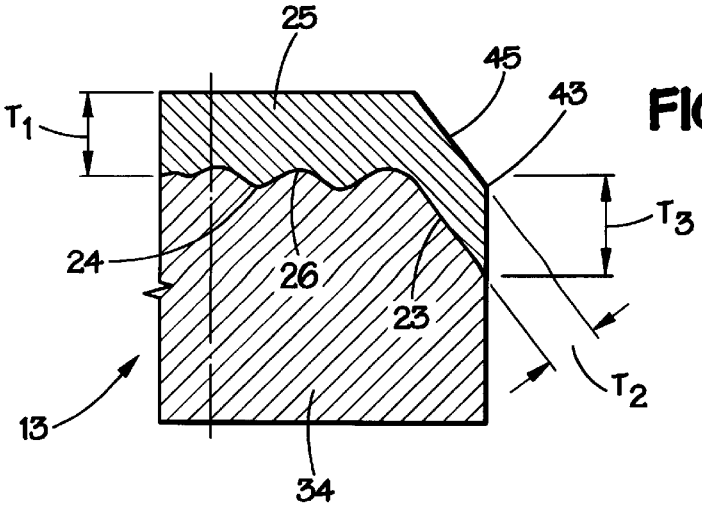
FIG. 8 illustrates a side, cross sectional view of one embodiment of the shaped cutter illustrated in FIG. 4A.

FIG. 8 illustrates a side cross-section of the stabilizing element 13 of the present invention as illustrated in FIG. 4A. By reference to FIG. 8, body 34 defines an interface or boundary 23 which includes a plurality of grooves 24 and ridges 26 running in a direction generally parallel to the line of contact defined between cutting edge 43 and the borehole (not shown). Such grooves and ridges aid in the relief of hoop stresses formed during the manufacturing phase and further addresses impact stresses encountered during operation.

In the embodiment illustrated in FIG. 8, the thickness of the diamond table 25 at cutting face 43 is designated $T_1$. In this embodiment, $T_1$ is substantially thickened to enhance the wear life of element 13 and is preferably between 0.020 and 0.060 inches in depth. Also in the illustrated embodiment, the thickness $T_2$ of the polycrystalline diamond disposed along rake land 45 is constant for its entire length. In a preferred embodiment, this thickness, when measured along a line normal to the plane defined by rake land 45, is between 0.020 and 0.060 inches.

As a result of the increased thickness of the polycrystallic diamond, the length of the rear boundary $T_3$ from cutting edge 43, as measured along the longitudinal axis, is between 0.010 and 0.060 inches. By way of comparison, the prior art cutter 81 illustrated in FIG. 5*b* includes no diamond 80 on the surface which contacts the formation, thereby shortening the life of the cutter by removal of the substrate 82. The prior art cutter of FIG. 5*a* includes more diamond to address the abrasion of the substrate, yet nevertheless demonstrates an abbreviated wear life. By using a specialty cutter with an increased thickness, an amount of diamond comparable to premium quality pdc cutters can be positioned on the surface of the cutter so as to be in contact with the formation. By enhancing the wear life of the stabilizing cutters to a point equivalent to that of the other cutters on the bit, an increase in the effective life of the bit is obtained.

Although particular detailed embodiments of the apparatus and method have been described herein, it should be understood that the invention is not restricted to the details of the preferred embodiment. Many changes in design, composition, configuration and dimensions are possible without departing from the spirit and scope of the instant invention.

What is claimed is:

1. A drilling tool operable with a rotational drive source for drilling in a subterranean formation to create a borehole comprising:

a drill bit body defining a bit face generally disposed about a longitudinal axis;

a plurality of first cutting elements fixedly disposed on and projecting from the bit face and spaced apart from one another where the rotation of said cutting elements about the longitudinal axis creates a cutter profile; and one or more stabilizing elements disposed on the bit face such that the stabilizing elements are maintained in substantially continuous contact with the formation, wherein stabilizing elements are disposed on the bit face at a contact angle of between 5 and 55 degrees as measured from a plane defined by the formation at the bottom of the borehole.

2. The drilling tool of claim 1 where the stabilizing elements are comprised of PDC.

3. The drilling tool of claim 1 where the drill bit body defines a pilot and a reamer, where said pilot and reamer define a bit face.

4. The drilling tool of claim 1 wherein the stabilizing elements define a beveled surface, where further the length of the bevel is substantially equal to or greater than the depth of cut into the formation per a given revolution of drilling tool for a cutter so positioned on the bit face at the same rotational velocity.

5. The drilling tool of claim 1 wherein the stabilizing elements define a cutting edge having a bevel of greater than or equal to 0.030 inches.

6. The drilling tool of claim 1 wherein the stabilizing elements define a back rake angle of between 30–70° as measured from a line normal to the plane defined by the formation at the bottom of the borehole.

7. The drilling tool of claim 3 where said stabilizing elements are disposed on the pilot.

8. The drilling tool of claim 3 where said stabilizing elements are disposed on the pilot and the reamer.

9. A bi-center drilling tool operable with a rotational drive source for drilling in a subterranean formation to create a borehole comprising:

a drill bit body defining a pilot and a reamer where each of said drill bit body and reamer define a bit face generally disposed about a longitudinal axis;

a plurality of first cutting elements fixedly disposed on and projecting from the bit face portion of the grill bit body and spaced apart from one another such that the rotation of the cutters on the bit face defines a cutter profile; and one or more stabilizing elements also disposed on the bit face of the drill bit body such that said elements are maintained in substantially continuous contact with the formation, wherein the stabilizing elements define a back rake angle of between 30–70° as measured from a line normal to the plane defined by the formation at the bottom of the borehole.

10. The drilling tool of claim 9 wherein the stabilizing elements comprise PDC cutters.

11. The drilling tool of claim 10 wherein the stabilizing elements define a beveled surface, where further the length of the bevel is substantially equal to or greater than the depth of cut into the formation formation where the bit includes a bit body and a bit face a cutter so positioned on the bit face at the same rotational velocity.

12. The drilling tool of claim 9 wherein the stabilizing elements define a cutting edge having a bevel of greater than or equal to 0.030 inches.

13. The drilling tool of claim 9 wherein stabilizing elements are disposed on the bit face at a contact angle of between 5 and 55 degrees as measured from a plane defined by the formation at the bottom of the borehole.

14. A stabilizing element for use on a drill bit for drilling subterranean foundation, said element defining a longitudinal axis and comprising:

a volume of abrasive material including:

a cutter face extending into two dimensions and generally transverse to said longitudinal axis;

a cutting edge at the periphery of said cutter face;

a rear boundary trailing said cutting edge at a longitudinal distance;

a rake land on said cutter face extending forwardly, inwardly from said cutting edge at an angle to said axis;

wherein said volume of said abrasive material has a thickness T, when measured normal to said rake land, of between 0.020 and 0.060 inches, where the distance between said cutting edge and said rear boundary is between 0.010 and 0.060 inches.

15. The stabilizing element of claim 14 where the length of the rake land is between 0.035 and 0.35 inches.

16. The stabilizing element of claim 14 where the abrasive material is bonded to a substrate comprised of cemented tungsten carbide.

17. The stabilizing element of claim 14 where the abrasive material is comprised of polycrystalline diamond.

18. The stabilizing element of claim 14 where the depth of the abrasive material, as measured along the longitudinal axis, is between 0.020 and 0.060.

19. The stabilizing element of claim 14 where the rake land is disposed at an angle between 5° and 55° as measured from the longitudinal axis.

20. The stabilizing element of claim 14 where the rake land is greater than or equal to 100% of the depth of cut for a cutter so positioned on the bit body at the same rotational velocity.

21. The stabilizing element of claim 14 further including an arcuate edge having a radius greater than or equal to 100% of the depth of cut for a cutting element disposed at that position on the bit body for the same rotational velocity.

22. A stabilizing element for use on a bit for drilling subterranean formation where the bit includes a bit body and a bit face, said element having a longitudinal axis and comprising;

a volume of superabrasive material including:

a generally planar cutting face and formed transverse to said longitudinal axis, where said cutting face defines a chamfer at its periphery, where said chamfer defines an angle;

a cutting edge at the periphery of said cutting face;

a rake land on said cutting face extending away from said cutting edge at an acute angle wherein said superabrasive material is bonded to a substrate about an interface, where the length of the rake land is drawn from the cutting edge to the interface, where the thickness of the superabrasive material $T_1$, as taken along a line normal to the rake land, is constant through the length of said rake land.

23. The stabilizing element of claim 22 wherein the thickness $T_1$ is between 0.020 and 0.060 inches.

24. The stabilizing element of claim 22 further defining a rear boundary between the superabrasive material and the substrate, where said boundary trails said cutting edge at a distance of between 0.010 and 0.060 inches.

25. The stabilizing element of claim 22 where the depth of the superabrasive material, as measured parallel to said longitudinal axis, is between 0.020 and 0.060.

26. The stabilizing element of claim 22 wherein said substrate is comprised of polycrystalline diamond.

27. The stabilizing element of claim 22 wherein said substrate is comprised of cemented tungsten carbide.

28. The stabilizing element of claim 22 wherein said chamfer angle is between 5° and 55° as measured from said longitudinal axis.

29. The stabilizing element of claim 22 wherein said rake land defines a length of between 0.035 and 0.35 inches.

30. The stabilizing element of claim 22 where the length of the rake land is greater than or equal to 100% of the depth of cut for a cutter so positioned on the bit body at the same rotational velocity.

31. The stabilizing element of claim 22 further including an arcuate edge having a radius greater than or equal to 100% of the depth of cut for a cutter so positioned on the bit body for the same rotational velocity.

32. The stabilizing element of claim 22 wherein the stabilizing elements are disposed about the bit face so that they maintain a constant angle "c" with respect to the formation in the range of 5–55 degrees, where the components of angle "c" include a back rake angle BR and a bevel or curve angle BA.

* * * * *

UNITED STATES PATENT AND TRADEMARK OFFICE

CERTIFICATE OF CORRECTION

PATENT NO. : 5,979,577

DATED : November 9, 1999

INVENTOR(S) : Fielder

It is certified that error appears in the above-identified patent and that said Letters Patent is hereby corrected as shown below:

At column 1, line 7, please add - - co-pending - - application Ser. No. 08/515,536, etc.

At column 3, line 30, please replace "sting" with - - string - -.

In the Claims:

Claim 3, Column 10, Line 37. Please add - - each - - said pilot and reamer, etc.

Claim 4, Column 10, Line 42. Please add - - the - - drilling tool for a cutter, etc.

Claim 9, Column 10, Line 63. Please replace "grill" with - - drill - -.

Claim 11, Column 11, Line 13. Please delete one instance of the word "formation".

Claim 22, Column 12, Line 6. Please replace "formation" with - - foundation - -.

Claim 22, Column 12, Line 11. Please delete the word "where".

Signed and Sealed this

Eighth Day of August, 2000

*Attest:*

Q. TODD DICKINSON

*Attesting Officer*

*Director of Patents and Trademarks*